US005577720A

United States Patent [19]

Laskowski

[11] Patent Number: 5,577,720

[45] Date of Patent: Nov. 26, 1996

[54] SELF-ADJUSTING SENSOR

[75] Inventor: Edward L. Laskowski, Seven Hills, Ohio

[73] Assignee: InterBold, N. Canton, Ohio

[21] Appl. No.: 416,262

[22] Filed: Apr. 4, 1995

[51] Int. Cl.[6] ..... B65H 7/12

[52] U.S. Cl. ..... 271/265.04; 271/263

[58] Field of Search ..... 271/262, 263, 271/265.04

[56] References Cited

U.S. PATENT DOCUMENTS

| | | | |
|---|---|---|---|
| 4,494,747 | 1/1985 | Graef et al. | 271/263 |
| 4,503,960 | 3/1985 | Koeleman et al. | 271/263 |
| 4,664,369 | 5/1987 | Graef et al. | 271/263 |
| 4,937,460 | 6/1990 | Duncan et al. | 271/263 |
| 5,011,128 | 4/1991 | Tsuji | 271/265.04 |
| 5,098,078 | 3/1992 | Nakanishi | 271/265.04 |

FOREIGN PATENT DOCUMENTS

| | | | |
|---|---|---|---|
| 8201698 | 5/1982 | WIPO | 271/263 |

*Primary Examiner*—H. Grant Skaggs

*Attorney, Agent, or Firm*—D. Peter Hochberg; Mark Kusner; Michael Jaffe

[57] ABSTRACT

A sensing device comprised of a sensing circuit which changes its operating characteristics when an object comes near it. The sensing circuit produces a change in output voltage proportional to the change in relative distance between the sensing circuit and an object. The actual output voltage is a function of both target distance and control circuit input voltage. The control circuit includes a comparator for comparing the steady state output voltage to a reference voltage and adjustment system for adjusting the input voltage to change the steady state output voltage such that the steady state output voltage approximately equals the reference voltage. The control circuit reacts only to reductions in the steady state output voltage, indicative of mechanical wear, and not to increases in output voltage, indicative of currency thickness measurement.

7 Claims, 2 Drawing Sheets

SELF-ADJUSTING SENSOR

FIELD OF THE INVENTION

The present invention relates generally to sensing devices, and more particularly to a self-adjusting sensor for detecting the thickness of sheet media. The present invention is particularly applicable for sensors used in detecting the thickness of currency in a currency dispensing device, and will be described with particular reference thereto. It will be appreciated, however, that the present invention finds advantageous application in other thickness sensing applications, as well as in applications requiring distance gage compensation to offset variations due to wear of mechanical parts.

BACKGROUND OF THE INVENTION

The present invention relates to a sensor apparatus of the type disclosed in Graef et al. U.S. Pat. No. 4,664,369 for detecting thickness of currency moving along a path in a currency dispensing device. Broadly stated, such apparatus includes a Y-shaped or wishbone-shaped element which is mounted to pivot on a pin or post. The Y-shaped element includes fingers at one end and a tab at the other end, and is mounted on the pin such that the fingers are biased against a plate across which the currency must travel. The tab end of the Y-shaped element includes a metal target which is positioned adjacent a proximity sensor. A set screw is used to adjust the position of the Y-shaped element on the pin to establish a predetermined spacing between the target and the proximity sensor. The proximity sensor acts as a signal generating device and is preferably the type which generates a voltage signal proportional to the distance of the metal target from the sensor.

As currency passes between the fingers of the Y-shaped element and the plate, the Y-shaped element pivots slightly about the pin, thereby displacing the metal target relative to the proximity sensor. Movement of the target relative to the proximity sensor produces a signal indicative of the distance of the sensor from the target. This signal produced by the proximity sensor is characteristic of the thickness of the currency sheet passing between the plate and the fingers.

The arrangement shown in the aforementioned U.S. Pat. No. 4,664,369 has proved to be an extremely successful device for detecting the thickness of currency. One problem associated with such device, however, is that periodic manual re-adjustment of the Y-shaped element is required to reposition the target relative to the proximity sensor, i.e., to center the target within the operating range of the sensor. This adjustment is required because mechanical parts, specifically the fingers of the Y-shaped element which is preferably made of plastic, are worn down by the passing sheets, causing the gap between the proximity sensor and the target to slowly change over time. In this respect, the proximity sensors are very sensitive, having an output voltage change of 0.4 volts for every 0.001 inch gap of change. Consequently, even the slightest wear of mechanical parts produces a noticeable change in the output voltage. This wear typically requires two or three adjustments during the life of the parts. In addition to the cost of a serviceman attending to such adjustments to the system in the field, the currency dispensing device, typically found in an ATM machine, is inoperable until such adjustment is made. In other words, an ATM or like device is out of service until the re-adjustment is made.

The present invention overcomes these and other problems and provides a self-adjusting feedback control circuit for automatically correcting sensor drift caused by mechanical wear.

SUMMARY OF THE INVENTION

In accordance with the present invention there is provided an apparatus for indicating the thickness of one or more sheets moving along a sheet path. The apparatus is comprised of a first surface positioned to engage sheets moving along the sheet path, the first surface having a first position relative to the path and being movable from the first position upon engagement with a sheet. A second surface is responsive to movement of the first surface, the second surface being movable from a rest position to a sensing position and having a reference position related to the initial rest position of the first surface. The second surface exhibits a displacement from the rest position indicative of movement of the first surface. Signal generating means are provided for generating electrical signals related to the displacement of the second surface from the rest position. The signal generating means includes a specific reference signal output when the second surface is at the reference position. A control circuit is connected to the signal generating means to electrically modify the signal generating means to maintain the reference signal output at a set value as the rest position of the second surface changes from the initial reference position as a result of mechanical wear of the first surface.

In accordance with another aspect of the present invention there is provided a sensing device comprised of a sensing circuit which changes its operating characteristics when an object comes near it. The sensing circuit produces an output voltage proportional to the relative distance between the sensing circuit and the object, the output voltage being a function of an input voltage across a portion of the sensing circuit. A control circuit is provided to control the input voltage of the sensing circuit. The control circuit includes comparator means for comparing the output voltage to a reference voltage and adjustment means for adjusting the input voltage to change the output voltage such that the output voltage equals the reference voltage.

In accordance with another aspect of the present invention there is provided a sensing device comprised of a sensing circuit which changes its operating characteristics when an object comes near it. The sensing circuit produces an electrical output signal proportional to the relative distance between the sensing circuit and the object. The output signal is a function of an electrical input signal across a portion of the sensing circuit. A control circuit is provided for controlling the input signal. The control circuit includes comparator means for comparing the output signal to a reference signal and adjustment means for adjusting the input signal to change the output signal such that the output signal is approximately equal to the reference signal.

In accordance with another aspect of the present invention there is provided an apparatus for indicating the thickness of one or more sheets moving along a sheet path comprising a first surface positioned to engage sheets moving along the sheet path. The first surface has a first position relative to the path and is movable from the first position upon engagement with a sheet. A second surface responsive to movement of the first surface is provided. The second surface has a rest position related to the first position of the first surface. The second surface exhibits a displacement from the rest position indicative of movement of the first surface. Signal generating means are provided for generating output electrical signals related to the position of the second surface. The second surface has a specific reference output signal indicative of its initial rest positions. Means for monitoring are provided for monitoring the rest position of the second surface over time to detect any changes in the rest position. Control means are connected to the signal generating means for modifying the signal generating means to compensate for changes in the rest position of the second surface. The control means modify the generating means to re-establish the specific reference signal output, after the rest position of the second surface has changed a predetermined amount.

It is an object of the present invention to provide a self-adjusting distance gage which compensates for mechanical wear with an electronic circuit.

Another object of the present invention is to provide a gage as described above for detecting the thickness of sheet media.

Another object of the present invention is to provide a gage as described above which utilizes a proximity sensor in conjunction with movable mechanical components.

Another object of the present invention is to provide a gage as defined above which does not require physical readjustment to compensate for wear of mechanical components.

Another object of the present invention is to provide a gage as described above which overcomes sensor drift caused by mechanical wear by means of electronic feedback control circuit.

Another object of the present invention is to provide a gage as described above which senses and compensates for voltage changes in a specific direction (i.e., positive or negative), but ignores voltage change in an opposite direction.

These and other objects and advantages will become apparent from the following description of a preferred embodiment of the invention taken together with the accompanying drawings.

BRIEF DESCRIPTION OF THE DRAWINGS

The invention may take form in certain parts and arrangement of parts, a preferred embodiment of which will be described in detail in the specification and illustrated in the accompanying drawings wherein.

DETAILED DESCRIPTION OF THE PREFERRED EMBODIMENT

Figure 1:
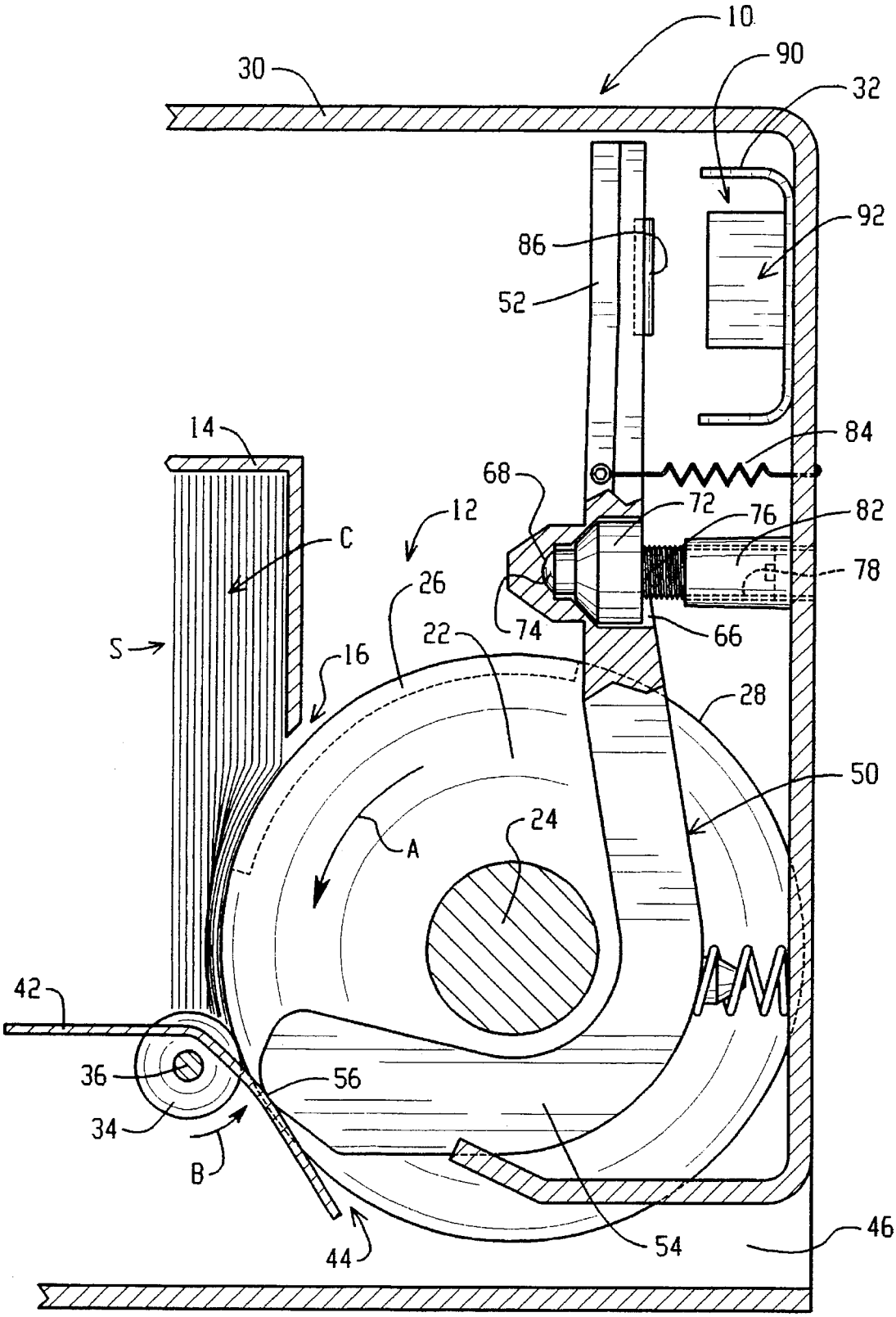
FIG. 1 is a side sectional view of a paper currency dispensing mechanism showing a currency thickness indicator arrangement illustrating an aspect of the present invention.

Referring now to the drawings wherein the showings are for the purpose of illustrating a preferred embodiment of the invention, and not for the purpose of limiting same, FIG. 1 shows a currency dispensing system 10 for dispensing single sheets of media. Currency dispensing system 10 includes a friction picker mechanism 12 for removing single sheets of a sheet media, specifically currency designated "C" in the drawing, from a stack designated "S". Stack S is contained within a canister 14 which is partially shown in FIG. 1. Canister 14 has an opening 16 at one end which exposes stack S to a picker roller 22 mounted for rotation on a shaft 24. Picker roller 22 includes a high friction circumferential portion 26 and a low friction circumferential portion 28. Picker roller 22 is positioned such that the circumference of roller 22 extends slightly into opening 16 of canister 14. Shaft 24 is mounted within a frame or housing 30 containing currency canister 14 and picker mechanism 12. Shaft 24 is driven by a stepper motor (not shown) under the control of a computer which operates the currency dispensing system 10 and picker mechanism 12.

Counter rotating rollers 34 are mounted on a shaft 36 to be disposed adjacent picker roller 22. The outer surface of counter rollers 34 are in close proximity to, but do not contact, picker roller 22. Counter rollers 34 are driven by means (not shown). During normal operation picker roller 22 rotates in the direction of arrow A and counter roller 34 rotates in the direction of arrow B. A plate 42 is mounted adjacent picker roller 22 and counter roller 34. Openings in plate 42 allow counter roller 34 to extend therethrough and allows a portion of picker roller 22 to intersect plate 42. Plate 42 defines a path, designated 44 in the drawings, along which sheets C of currency are passed. A dispensing passage 46 is formed in housing 30 to discharge sheets S therefrom.

Picker mechanism 12 includes a generally Y-shaped or wishbone-shaped element 50. Y-shaped element 50 includes an upper leg portion 52 and two spaced apart lower leg portions 54. Lower leg portions 54 are generally hook-shaped as shown in FIG. 1 and are spaced apart to be positioned on opposite sides of picker roller 22 with the hook-shaped portion extending around shaft 24. The free end of lower leg portions 54 have a contoured surface 56 adapted to engage plate 42 and to engage sheets S which pass therealong. At the midsection of Y-shaped element 50, i.e., at the junction where the lower legs 54 join with upper leg 52, a cavity 66 is formed therein. Cavity 66 is generally cylindrical in shape and includes a spherical bottom 68. Cavity 66 is provided to receive an adjustable mounting pin 72 which has a semi-spherical end portion 74. Semi-spherical end portion 74 is dimensioned to mate with spherical bottom 68 of cavity 66 wherein Y-shaped element 50 may freely pivot on mounting pin 72. Pin 72 is attached to a threaded rod 76 which extends into a threaded bore 78 in a post 82 which is formed or otherwise attached to housing 30. The position of mounting pin 72 is thus adjustable along the axis of threaded rod 76. Above mounting pin 72 a torsion spring 84 is attached to upper leg portion 52 and to housing 32. Torsion spring 84 and compression spring 62 are operable to urge contoured surface 56 of lower leg portions 54 into engagement with plate 42.

A target 86, which in the preferred embodiment is a disk of metallic material, is fixedly mounted to upper leg portion 52 so as to be integral and movable therewith.

A sensor arrangement 90 is mounted to housing 30 adjacent target 86. Sensor arrangement 90 acts as a signal generating means and is preferably the type which generates a voltage signal proportional to the distance of the plane of the face of the metallic target 86 from sensor arrangement 90.

Figure 2:
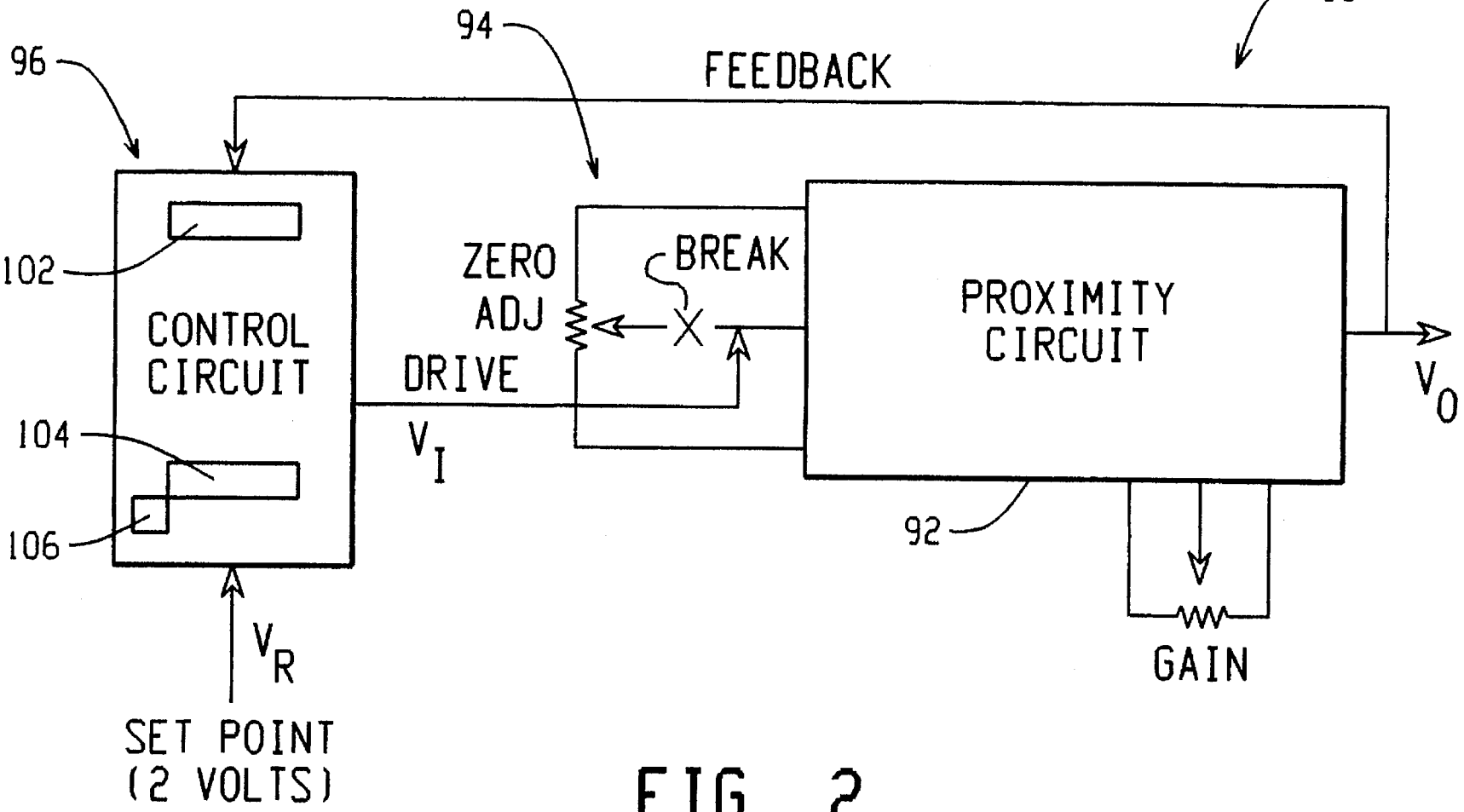
FIG. 2 is a drawing schematically illustrating the control circuit for the currency thickness apparatus shown in FIG. 1.

Referring now to FIG. 2, a schematic block diagram of sensor arrangement 90 is shown. Sensor arrangement 90 is generally comprised of a magnetic proximity sensing device, designated 92 in the drawings, which changes its operating characteristics when an object, specifically a metallic object, comes near it, such as Model No. 921H26Q manufactured by Micro Switch, a Division of Honeywell Corporation of Illinois. Such a sensor produces an output voltage, designated "$V_o$" in the drawing, whose change is proportional to the relative distance between the sensor and target 86. A portion of sensor circuit 92 includes a potentiometer 94 which is used during calibration of sensor 92 to set the appropriate zero value or reference value. In this respect, the steady state output voltage $V_o$ of sensor circuit 92 is adjustable, i.e., variable, by means of potentiometer 94, the output of sensor circuit 92 however still being proportional to the relative distance between sensor circuit 92 and target 86 and added to the steady state value.

According to the present invention, a feedback control circuit 96 is added to existing sensor circuit 92. Feedback control circuit 96 automatically readjusts the steady state voltage output $V_o$ of sensing circuit 92 by generating an input or drive value, designated by $V_I$, to sensing circuit 92. Specifically, control circuit 96 produces an input voltage $V_I$ replacing the one derived from the center tap of voltage divider potentiometer 94. Input voltage $V_I$ from control circuit 96 is based upon the comparison between the actual steady state output voltage $V_o$ of sensing circuit 92 and a desired setpoint or reference voltage designated $V_R$. Control circuit 96 compares the steady state actual output voltage $V_o$ with the reference voltage $V_R$ and adjusts the input voltage $V_I$ to make the steady state output voltage $V_o$ equal to the reference voltage $V_R$. As used herein the term steady state output voltage $V_o$ refers to the output voltage when no sheet media or currency C is between countered surface 56 of Y-shaped element 50 and plate 42. In this respect, as will be appreciated, as currency C passes between plate 42 and contoured surface 56, voltage output $V_o$ increases to reflect the change in position of target 86 relative to sensor arrangement 90. Thus, control circuit 96 is adapted to adjust input voltage $V_I$, and therefore, the steady state of the output voltage $V_o$ only when a drop from the steady state output voltage of the circuit is detected in output voltage $V_o$.

Control circuit 96 includes comparator means 102 for comparing the output voltage $V_o$ to the reference voltage $V_R$, and further includes adjustment means 104 for adjusting the input voltage $V_I$ until the output voltage $V_o$ equals the reference voltage $V_R$. Importantly, according to the present invention, control circuit 96 adjusts the input voltage $V_I$ only when the idle or steady state output designated $V_o$ shows a gradual permanent change over time in one direction. For example, control circuit 96 may be programmed or designed to adjust the input voltage $V_I$ when the steady state output voltage $V_o$ shows a gradual permanent reduction over time. For example, in the embodiment shown, sensing circuit 96 may have an operating range of 0 to 10 volts. The reference voltage $V_o$ may be set to 2 volts thereby provide an 8 volts range for the detection of thicker media or multiples of media. Previous systems had to have the steady state output voltage $V_o$ set to a higher value than 2 volts, say 5 volts, to allow for deterioration caused by part wear. This reduces the dynamic operating measurement range to span only 5 to 10 volts, limiting the maximum media thickness measurement capability. Control circuit 96 may be programmed or designed to adjust the input voltage $V_I$ only after the output voltage $V_o$ drops below 1.95 volts. When the output voltage drops below 1.95 volts, control circuit 96 adjusts input voltage $V_I$ to bring the steady state output voltage $V_I$ to 2 volts or to a range near 2 volts, e.g., 1.99 volts to 2.01 volts, or some other acceptable window.

In the embodiment shown, control circuit 76 is adapted to adjust the input voltage $V_I$ when the output voltage $V_o$ from sensor circuit 92 gradually decreases. The decrease is a result of target 86 moving slightly closer to sensing circuit 92, which movement is caused by surface 56 of Y-shaped element 50 gradually wearing over time due to the sheets S repeatedly sliding thereagainst. In this respect, large increases in the output voltage $V_o$ of sensor circuit 92 are attributable to currency passing between plate 42 and surface 56 of lower leg portion 54. Alternately, control circuit 96 may be designed or programmed to adjust the input voltage $V_I$ only when the output voltage $V_o$ exhibits a gradual permanent voltage increase over time.

Control circuit 96 is preferably includes processing means (not shown) for performing the comparison function and the voltage adjustment function. Memory means 106 may also be provided to monitor the rate of adjustment and to determine when the voltage input $V_I$ adjustment has reached a predetermined maximum amount whereafter further adjustment to the input voltage $V_I$ is prevented and a signal is provided that the maximum allowable adjustment has been reached. In this respect, the adjustment limit indicates when excessive wear of contoured surface 56 of lower leg portion 54 has occurred wherein the shift of target 86 relative to sensing circuit 92 may be beyond its operating range.

Referring now to the operation of the present invention, as sheets S are dispensed from currency dispensing system 10 under the influence picker roller 22, sheets C pass between plate 42 and contoured surface 56 of Y-shaped element 50. The thickness of sheet C causes Y-shaped element 50 to pivot on mounting pin 72 causing target 86 to move relative to sensor circuit 92. The relative movement produces a voltage change in sensor arrangement 90 which is indicative of the thickness of sheet C. A more detailed description of the operation of such an arrangement may be found in Graef et al., U.S. Pat. No. 4,664,369 the disclosure of which is incorporated herein in its entirety. Numerous and repeated dispensing of sheets C will eventually cause contoured surface 56 of Y-shaped element 50 to wear or erode away thereby causing target 86 to move slightly closer to sensing circuit 92. As indicated in the Background of the Specification, even minor changes in the position of target 86 produce noticeable deviations in the voltage output $V_o$ of sensor circuit 92. According to the present invention, the gradual shifting of the neutral position of target 86 relative to sensor circuit 92 is compensated for by control circuit 96 which adjusts the input voltage $V_I$ to sensor circuit 92 to maintain the steady state output voltage $V_o$ of the sensor at a predetermined reference value $V_R$. Thus, the wearing of contoured surface 56 of lower leg portion 54 is electrically compensated for by control circuit 96.

Importantly, a system as defined above allows for high sensitivity measurements of differential positions while maintaining a capability of a large dynamic measurement range. Any increase in the output voltage $V_o$ of sensor circuit 92 is attributed to medium measurement, and any gradual decrease in the voltage output $V_o$ is attributed to mechanical wear, and the control circuit adjusts the input voltage $V_I$ of sensor circuit 92 back to the reference voltage $V_R$. With the foregoing arrangement, the setpoint or reference point of the system can be chosen to be a much lower value than the previous system. This allows for thicker or larger multiples of media to be detectable over a larger range. In this respect, because the output voltage $V_o$ of sensing circuit 92 is controlled to be at the reference or setpoint voltage $V_R$, it does not change with wear in the mechanical components which means that the dynamic measurement range remains constant. Further, the actual value of the "adjustment" to the input voltage $V_I$ is a direct measurement of the distance target 86 has moved relative to sensing circuit 92 as a result of wear. In this respect, the "adjustment" value can used as an indication of wear and to predict ultimate failure of the system. Importantly, by producing the setpoint or reference point at a lower value with a larger dynamic range, a system according to the present invention is operable for longer periods of time without requiring mechanical readjustment of mounting pin 72 to bring a system back into operable range.

It is intended that all such modifications and alterations be included insofar as they come within the scope of the patent as claimed or the equivalents thereof.

Having described the invention, the following is claimed:

1. An apparatus for indicating the thickness of one or more sheets moving along a sheet path comprising:

a first surface positioned to engage sheets moving along said sheet path, said first surface having a first position corresponding to the absence of a sheet, and being movable from said first position upon engagement with a sheet;

a second surface responsive to movement of said first surface, said second surface movable from a rest position, corresponding to the first position, to a sensing position, said second surface exhibiting a displacement from said rest position indicative of movement of said first surface from said first position;

signal generating means generating electrical signals related to the displacement of said second surface from said rest position, said signal generating means providing a reference signal output when said second surface is at said rest position; and a control circuit connected to said signal generating means to electrically modify said generating means to maintain said reference signal output, as the rest position of said second surface changes as a result of mechanical wear of said first surface.

2. An apparatus as defined in claim 1, wherein said signal generating means is a non-contact sensor.

3. An apparatus as defined in claim 2, wherein said generating means is a proximity sensor.

4. An apparatus as defined in claim 1, wherein said control circuit includes means for monitoring the change in the rest position of said second surface.

5. An apparatus as defined in claim 4, wherein said control circuit modifies said generating means when said rest position of said second surface changes over time by a predetermined amount.

6. An apparatus for indicating the thickness of one or more sheets moving along a sheet path comprising:

a first surface positioned to engage sheets moving along said sheet path, said first surface having a first position relative to said path and being movable from said first position upon engagement with a sheet, said first position corresponding to the absence of a sheet;

a second surface responsive to movement of said first surface, said second surface having a rest position related to the first position of said first surface, said second surface exhibiting a displacement from said rest position indicative of movement of said first surface;

signal generating means generating output electrical signals related to the position of said second surface; said second surface having a reference output signal indicative of said rest position;

means for monitoring said rest position of said second surface over time to detect any changes in said rest position;

control means connected to said signal generating means for modifying said signal generating means to compensate for changes in said rest position of said second surface, said control means modifying said signal generating means to re-establish said reference signal output, after said rest position of said second surface has changed a predetermined amount.

7. An apparatus for indicating the thickness of one or more sheets moving along a sheet path comprising:

a first member positioned to engage sheets moving along said sheet path, said first member having a first position relative to said path corresponding to the absence of a sheet, and being movable from said first position upon engagement with at least one sheet;

a second member responsive to movement of said first member, said second member movable from a rest position corresponding to said first position, said second member exhibiting a displacement from said rest position indicative of movement of said first member from said first position;

signal generating means for generating an electrical signal related to displacement of said second member from said rest position, wherein said electrical signal has an initial reference value when said second member is at said rest position; and control means connected to said signal generating means to maintain said initial reference value, as said rest position changes as a result of mechanical wear of said first member.

* * * * *